US012054819B1

(12) United States Patent
Cheung et al.

(10) Patent No.: US 12,054,819 B1
(45) Date of Patent: Aug. 6, 2024

(54) AMORPHOUS ALLOY

(71) Applicant: Chow Sang Sang Jewellery Company Limited, Hong Kong (CN)

(72) Inventors: Wai Kei Cheung, Hong Kong (CN); Shuk Kwan Mak, Hong Kong (CN); Mei Tsz Macy Wong, Hong Kong (CN)

(73) Assignee: CHOW SANG SANG JEWELLERY COMPANY LIMITED, Hong Kong (CN)

( * ) Notice: Subject to any disclaimer, the term of this patent is extended or adjusted under 35 U.S.C. 154(b) by 0 days.

(21) Appl. No.: 18/372,683

(22) Filed: Sep. 25, 2023

(30) Foreign Application Priority Data

Sep. 15, 2023 (HK) ..... 32023079214.7

(51) Int. Cl.
*C22C 45/00* (2023.01)
*C22C 1/11* (2023.01)
*C22C 5/02* (2006.01)

(52) U.S. Cl.
CPC ..... *C22C 45/003* (2013.01); *C22C 1/11* (2023.01); *C22C 5/02* (2013.01); *C22C 2200/02* (2013.01)

(58) Field of Classification Search
CPC ..... C22C 45/003
See application file for complete search history.

(56) References Cited

U.S. PATENT DOCUMENTS

| | | | | |
|---|---|---|---|---|
| 9,695,494 | B2 | 7/2017 | Schroers et al. | |
| 10,895,004 | B2 | 1/2021 | Na et al. | |
| 2008/0185076 | A1* | 8/2008 | Schroers | C22C 45/003 148/403 |
| 2015/0344999 | A1* | 12/2015 | Na | C22C 45/003 148/403 |

FOREIGN PATENT DOCUMENTS

| | | | |
|---|---|---|---|
| CN | 1055134 | A | 10/1991 |
| CN | 1388839 | A | 1/2003 |
| CN | 106119589 | A | 11/2016 |
| CN | 108315673 | A | 7/2018 |
| CN | 109022889 | A | 12/2018 |
| JP | 2006274380 | A | 10/2006 |
| WO | 2018/001564 | A1 | 1/2018 |

OTHER PUBLICATIONS

Chen, H. S., and D. Turnbull. 1968. 'Evidence of a Glass-Liquid Transition in a Gold-Germanium-Silicon Alloy', The Journal of Chemical Physics, 48: 2560-71.

(Continued)

*Primary Examiner* — Keith D. Hendricks
*Assistant Examiner* — Joshua S Carpenter
(74) *Attorney, Agent, or Firm* — Law Offices of Albert Wai-Kit Chan, PLLC

(57) ABSTRACT

This invention provides an amorphous alloy. In one embodiment, the amorphous alloy consists essentially of: i) 52.55-80.12 at. % of Au; ii) 11.74-15.55 at. % of Ge; iii) 8.13-10.77 at. % of Si; iv) 5-21.13 at. % being at least one element selected from the group consisting of Ag, Bi, Pd and Pt.

19 Claims, 3 Drawing Sheets

(56) References Cited

OTHER PUBLICATIONS

Demetriou, Marios D., Michael Floyd, Chase Crewdson, Joseph P. Schramm, Glenn Garrett, and William L. Johnson. 2011. 'Liquid-like platinum-rich glasses', Scripta Materialia, 65: 799-802.
Eisenbart, Miriam. 2015. 'On the Processing and the Tamishing Mechanism of Gold-based Bulk Metallic Glasses', der Universitat des Saarlandes.
Eisenbart, Miriam, Ulrich E. Klotz, Ralf Busch, and Isabella Gallino. 2014. 'A colourimetric and microstructural study of the tarnishing of gold-based bulk metallic glasses', Corrosion Science, 85: 258-69.
Eisenbart, Miriam, Ulrich E. Klotz, Ralf Busch, and Isabella Gallino. 2014. 'On the abnormal room temperature tarnishing of an 18 karat gold bulk metallic glass alloy', Journal of Alloys and Compounds, 615: S118-S22.
Gokhale, Sunil V., Krassimir G. Marchev, Welville B. Nowak, and Bill C. Giessen. 1993. 'Au0.80Cu0.10Y0.10, A Gold-Rich Ternary Alloy Glass with Tc > 400° C. and its Crystallization Kinetics', MRS Online Proceedings Library, 321: 639-43.
Gross, Oliver, Miriam Eisenbart, Lisa-Y. Schmitt, Nico Neuber, Lamia Ciftci, Ulrich E. Klotz, Ralf Busch, and Isabella Gallino. 2018. 'Development of novel 18-karat, premium-white gold bulk metallic glasses with improved tarnishing resistance', Materials & Design, 140: 495-504.
Houghton, O. S. 2022. "A Search for Long-Lasting Luster and Fineness: Developments in Bulk Metallic Glasses for Jewelry." In Santa Fe Symposium, 263-86. Albuquerque, NM: Santa Fe Symposium.
Houghton, O. S. 2023. "Bulk Metallic Glasses and Precious Metals: Progress on the Issues." In Jewelry Technology Forum. Vicenza.
Houghton, O. S., and A. L. Greer. 2021. 'A Conflict of Fineness and Stability: Platinum- and Palladium-Based Bulk Metallic Glasses for Jewellery: Part I : Introduction and properties of platinum- and palladium-based bulk metallic glasses', Johnson Matthey Technology Review, 65: 506-18.
Houghton, O. S., and A. L. Greer. 2021. 'A Conflict of Fineness and Stability: Platinum- and Palladium-Based Bulk Metallic Glasses for Jewellery: Part II : Processing, tarnish resistance and future developments', Johnson Matthey Technology Review, 65: 519-34.
Klotz, U. E. 2013. "Gold-Based Bulk Metallic Glasses: Hard Like Steel, Moldable Like Plastics." In Santa Fe Symposium. Albuquerque, NM: Santa Fe Symposium.
Lee, C. J., Y. H. Lai, C. W. Tang, J. C. Huang, and J. S. C. Jan. 2009. 'Mechanical Behavior of Au-Based Metallic Glass in Micro-Scale at Ambient and Elevated Temperatures', Materials Transactions, 50: 2795-800.
Lohwongwatana, Boonrat, William L. Johnson, and Jan Schroers. 2007. "Liquidmetal—Hard 18K and .850Pt Alloys That Can Be Processed Like Plastics or Blown Like Glass." In Santa Fe Symposium, 289-303. Albuquerque, NM: Santa Fe Symposium.
Mozgovoy, S., J. Heinrich, U. E. Klotz, and R. Busch. 2010. 'Investigation of mechanical, corrosion and optical properties of an 18 carat Au—Cu—Si—Ag—Pd bulk metallic glass', Intermetallics, 18: 2289-91.
Na, Jong Hyun, Kyung Hee Han, Glenn R. Garrett, Maximilien E. Launey, Marios D. Demetriou, and William L. Johnson. 2019. 'Designing color in metallic glass', Scientific Reports, 9: 3269.
Neuber, Nico, Maximilian Frey, Oliver Gross, Jörg Baller, Isabella Gallino, and Ralf Busch. 2020. 'Ultrafast scanning calorimetry of newly developed Au—Ga bulk metallic glasses', Journal of Physics: Condensed Matter, 32: 324001.
Neuber, Nico, Oliver Gross, Miriam Eisenbart, Alexander Heiss, Ulrich E. Klotz, James P. Best, Mikhail N. Polyakov, Johann Michler, Ralf Busch, and Isabella Gallino. 2019. 'The role of Ga addition on the thermodynamics, kinetics, and tarnishing properties of the Au—Ag—Pd—Cu—Si bulk metallic glass forming system', Acta Materialia, 165: 315-26.
Rizzi, Paola, Ingrid Corazzari, Gianluca Fiore, Ivana Fenoglio, Bice Fubini, Saulius Kaciulis, and Livio Battezzati. 2013. Ion release and tarnishing behavior of Au and Pd based amorphous alloys in artificial sweat, Corrosion Science, 77: 135-42.
Schroers, Jan, and William L. Johnson. 2004. 'Ductile Bulk Metallic Glass', Physical Review Letters, 93: 255506.
Schroers, Jan, Boonrat Lohwongwatana, William L. Johnson, and Atakan Peker. 2005. 'Gold based bulk metallic glass', Applied Physics Letters, 87.
Schroers, Jan, Boonrat Lohwongwatana, William L. Johnson, and Atakan Peker. 2007. 'Precious bulk metallic glasses for jewelry applications', Materials Science and Engineering: A, 449-451: 235-38.
Senkov, O. N., and D. B. Miracle. 2001. 'Effect of the atomic size distribution on glass forming ability of amorphous metallic alloys', Materials Research Bulletin, 36: 2183-98.
Tangpatjaroen, Chaiyapat, Punnathat Bordeenithikasem, Naphat Korwanich, Ekasit Nisaratanaporn, and Boonrat Lohwongwatana. 2013. "Cheap and Quick Thermoplastic Process for 18K Gold Alloys as an Alternative to Lost-wax Casting." In Santa Fe Symposium. Albuquerque, NM: Santa Fe Symposium.
Wang, Shuo-Hong, and Tsung-Shune Chin. 2012. 'Tin-modified gold-based bulk metallic glasses', Gold Bulletin, 45: 3-8.
Zhang, W., H. Guo, M. W. Chen, Y. Saotome, C. L. Qin, and A. Inoue. 2009. 'New Au-based bulk glassy alloys with ultralow glass transition temperature', Scripta Materialia, 61: 744-47.

* cited by examiner

AMORPHOUS ALLOY

FIELD OF THE INVENTION

The present invention relates to gold based bulk metallic glass with improved tarnish resistance. The invention also relates to an ornament or a piece of jewelry comprising at least one component made of such alloys.

BACKGROUND OF THE INVENTION

Bulk metallic glasses, also known as amorphous alloys, are alloys which, with sufficiently high cooling rates, solidify to metastable amorphous solids. To achieve cooling rate below critical cooling rate during casting, the thickness of the cast objects is limited as critical casting thickness $d_c$. Within the supercooled liquid region ($\Delta T_x$) of a metallic glass, i.e., the temperature ranges between glass transition temperature ($T_g$) and crystallization temperature ($T_x$), it performs like plastic and deforms with applied pressure. Metallic glasses may have very different properties than conventional crystalline metal alloys. There are a few advantages of metallic glass white gold in jewelry application such as near net-shape forming, high hardness and strength; and remarkably high whiteness over conventional 18K white gold alloys.

In U.S. Pat. No. 9,695,494 B2, a gold based metallic glass, $Au_{49}Ag_{5.5}Pd_{2.3}Cu_{26.9}Si_{16.3}$ was reported. The formula was based on the ternary eutectic Au—Cu—Si system. The gold content of the alloy is above 76 w.t. % so it can be hallmarked as 18 karat gold. The alloy was also reported to have high hardness up to 360 Hv and high yield strength up to 1100 MPa. The as polished alloy can be graded as "premium white" (yellowness index 17.8). However, this alloy has poor tarnish resistance. It discolored severely to "off white" in a few days in a wearing test. The mechanism of tarnishing in the Au—Cu—Si based metallic glass was later determined to be the formation of amorphous silicon oxide dendrite growing into the base metal, followed by copper oxide layer embossing on the surface. Therefore, the alloy turns reddish eventually. From the mechanism, the presence of Cu and Si are the culprits of tarnish. An approach to improve tarnish resistance is to lower the Cu/Si ratio. 2 variations of the Au—Cu—Si based BMG were later reported in W.O. Pat. No. 2018/001564. Cu was partially substituted by Ga and Sn. In a wearing test, it was concluded that the tarnish resistance of $Au_{51.6}Ag_{5.8}Pd_{2.4}Cu_{20.2}Si_{13.3}Ga_{6.7}$ was half of $Au_{49}Ag_{5.5}Pd_{2.3}Cu_{26.9}Si_{16.3}$. Another approach is to investigate into alternative alloy systems that avoid the use of Cu or Si.

A ternary Cu-free eutectic system Au—Ge—Si was found to have glass-liquid transition (Chen, H. S. et al. "Evidence of a Glass-Liquid Transition in a Gold-Germanium-Silicon Alloy," The Journal of Chemical Physics. 48(6), 2560-2571 (1968), the disclosure of which is incorporated herein by reference in its entirety). The alloy $Au_{77}Ge_{13.65}Si_{9.45}$ was produced by splat quenching techniques. The splatted films produced were about 20 microns on average. Glass transition temperature was reported to be 290-295K. Crystallization temperature was about 304K. The low glass transition temperature and low critical casting thickness made it impossible for jewelry production and application.

SUMMARY OF THE INVENTION

This invention provides an amorphous alloy. In one embodiment, said amorphous alloy consists essentially of: i) 52.55-80.12 at. % of Au; ii) 11.74-15.55 at. % of Ge; iii) 8.13-10.77 at. % of Si; iv) 5-21.13 at. % being at least one element selected from the group consisting of Ag, Bi, Pd and Pt.

This invention also provides a method for manufacturing the amorphous alloy of this invention. In one embodiment, said method comprises the step of adding elements to a crucible in one of the following order, from bottom to top: i) Pd—Ag—Au—Bi—Ge—Si; ii) Pt—Ag—Au—Bi—Ge—Si; iii) Pd/Pt—Ag—Au—Bi—Ge—Si.

This invention further provides a decorative item comprising at least one component made of the amorphous alloy of this invention.

The present invention is directed to Au-based bulk-solidifying amorphous alloys.

It is another object of the present invention that the Au-based alloys are based on ternary Au—Ge—Si alloys.

It is another object of the present invention that the Au—Ge—Si system is extended to higher alloys by adding one or more elements selected from Ag, Pd, Pt and Bi.

It is another object of the present invention that it improves glass forming ability over the ternary Au—Ge—Si alloys.

It is another object of the present invention that it improves thermal stability over the ternary Au—Ge—Si alloys.

It is another object of the present invention that it improves tarnish resistance over the Au—Cu—Si based BMGs.

It is another object of the present invention that is suitable for application in jewelry.

DETAILED DESCRIPTION OF THE INVENTION

Figure 1:
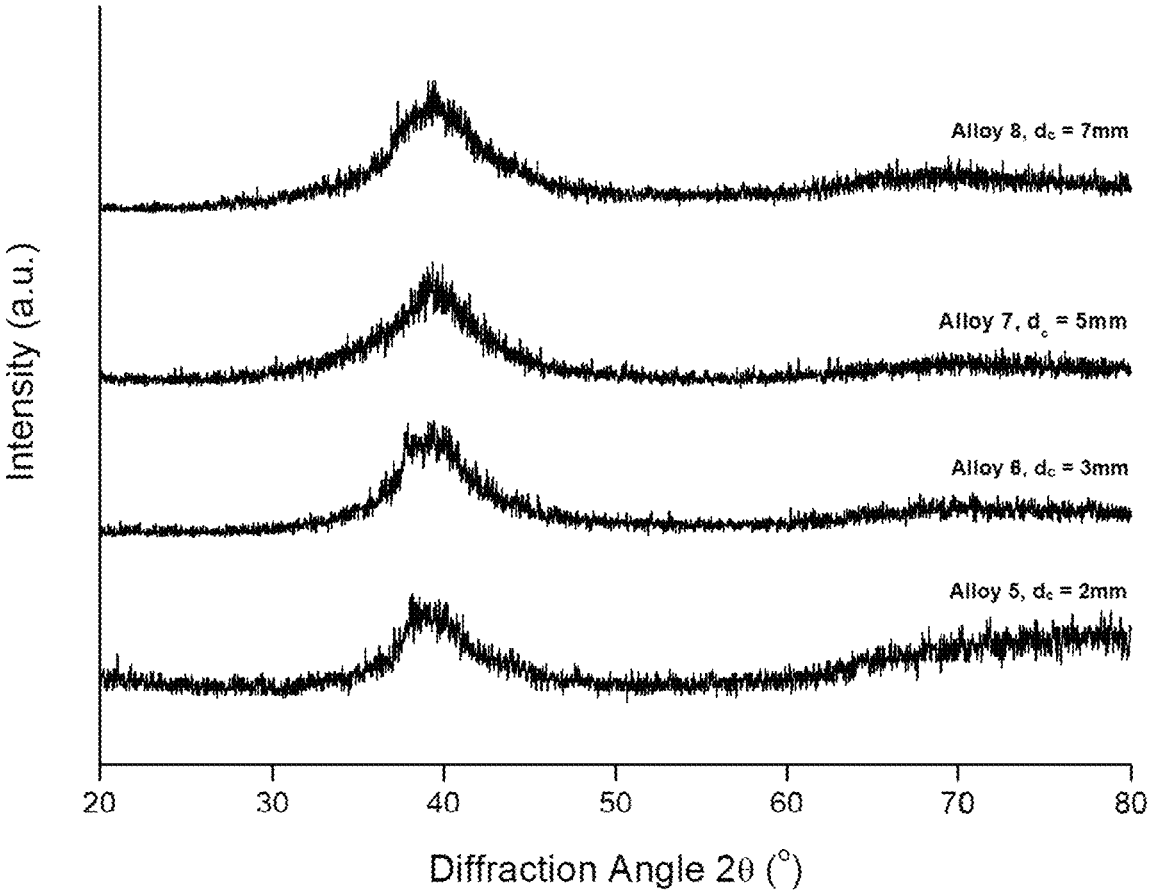
FIG. 1 is the x-ray diffractogram patterns of as cast Alloy 5 to 8 at their critical casting thickness.
Figure 2:
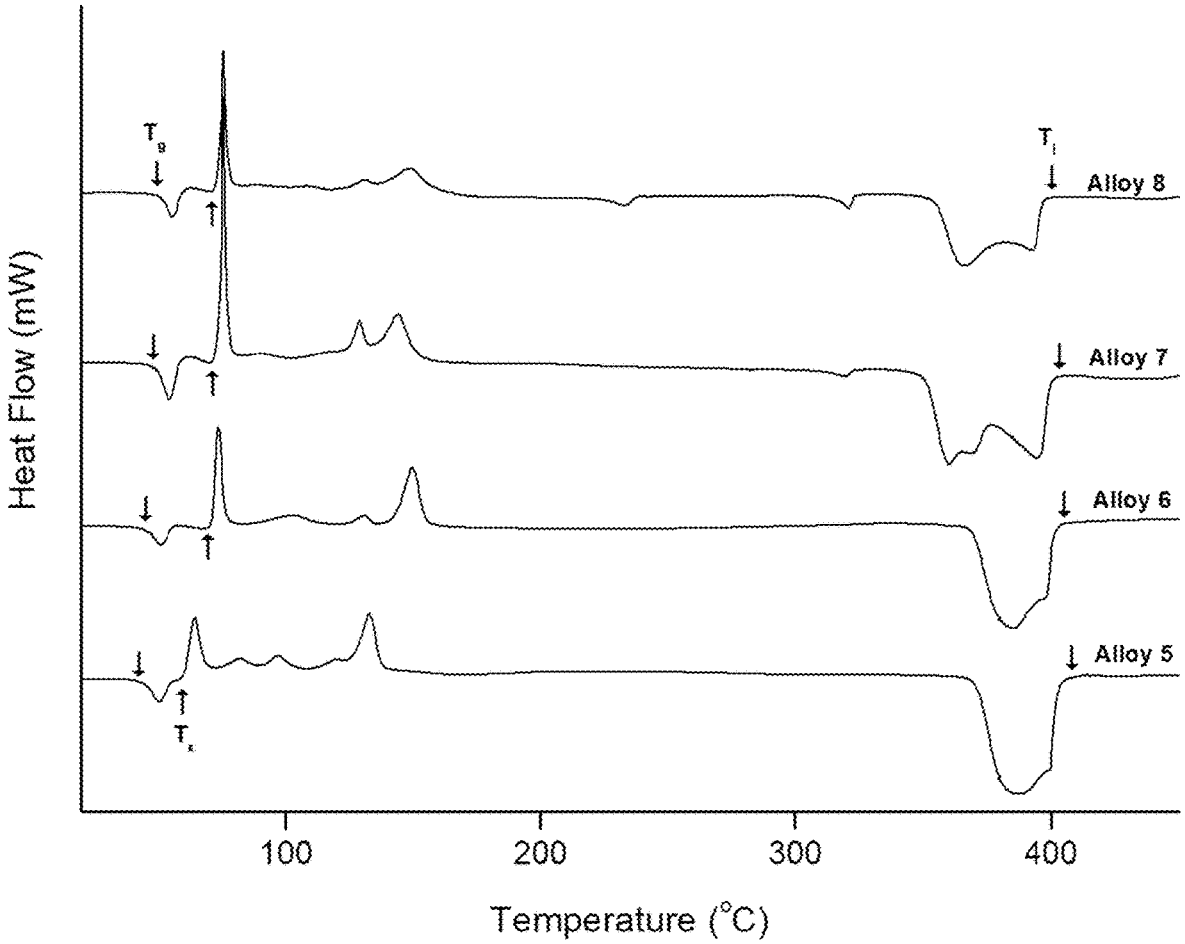
FIG. 2 is the DSC thermograms of as cast Alloy 5 to 8.

The following terms shall be used to describe the present invention. In the absence of a specific definition set forth herein, the terms used to describe the present invention shall be given their common meaning as understood by those of ordinary skill in the art.

As used herein, the expression BMG refers to bulk metallic glass.

As used herein, the expression a.t. % refers to atomic percentage.

As used herein, the expression $d_c$ refers to critical casting thickness.

As used herein, the expression $T_g$ refers to glass transition temperature.

As used herein, the expression $T_x$ refers to crystallization temperature.

As used herein, the expression $\Delta T_x$ refers to supercooled liquid region, the difference between $T_g$ and $T_x$.

As used herein, the expression $T_1$ refers to liquidus temperature.

As used herein, the expression YI refers to yellowness index.

As used herein, the expression XRD refers to x-ray diffraction.

As used herein, the expression DSC refers to differential scanning calorimetry.

As used herein, the expression ΔE* refers to the separation between two colours. ΔE* is calculated by the following equation:

$$\Delta E^* = \sqrt{\Delta L^{*2} + \Delta a^{*2} + \Delta b^{*2}}$$

while L*, a* and b* are axes in CIELAB coordinates.

This invention provides an amorphous alloy. In one embodiment, said amorphous alloy consists essentially of: i) 52.55-80.12 at. % of Au; ii) 11.74-15.55 at. % of Ge; iii) 8.13-10.77 at. % of Si; iv) 5-21.13 at. % being at least one element selected from the group consisting of Ag, Bi, Pd and Pt.

In one embodiment, said at least one element is selected from the group consisting of: i) 5-10 at. % of Ag; ii) 0.01-8.69 at. % of Bi; iii) 0.01-2.44 at. % of Pd; iv) 0.01-2.44 at. % of Pt; and v) 0.01-2.44 at. % of Pd and Pt in total.

In one embodiment, said amorphous alloy consists essentially of: 69.4 at. % of Au; 13.65 at. % of Ge; 9.45 at. % of Si; and 7.5 at. % of Ag.

In one embodiment, said amorphous alloy consists essentially of: 68.2 at. % of Au; 13.65 at. % of Ge; 9.45 at. % of Si; 7.5 at. % of Ag; and 1.2 at. % of Pd.

In one embodiment, said amorphous alloy consists essentially of: 65.83 at. % of Au; 13.65 at. % of Ge; e 7.5 at. % of Ag; 1.2 at. % of Pd; and 2.37 at. % of Bi.

In one embodiment, said amorphous alloy consists essentially of: 63.46 at. % of Au; 13.65 at. % of Ge; 9.45 at. % of Si; 7.5 at. % of Ag; 1.2 at. % of Pd; and 4.74 at. % of Bi.

In one embodiment, said amorphous alloy consists essentially of one or more combination of elements selected from the group consisting of: i) 63.68-73.59 at. % of Au, 12.65-15.55 at. % of Ge, 8.76-10.77 at. % of Si and 5-10 at. % of Ag; ii) 61.28-72.99 at. % of Au, 12.65-15.55 at. % of Ge, 8.76-10.77 at. % of Si, 5-10 at. % of Ag and 0.6-2.4 at. % of Pd; iii) 52.59-71.49 at. % of Au, 12.65-15.55 at. % of Ge, 8.76-10.77 at. % of Si, 5-10 at. % of Ag, 0.6-2.4 at. % of Pd; and 1.5-8.69 at. % of Bi; iv) 66.85-71.85 at. % of Au, 12.65-14.65 at. % of Ge, 9-10 at. % of Si; and 6.5-8.5 at. % of Ag; v) 64.45-70.95 at. % of Au, 12.65-14.65 at. % of Ge, 9-10 at. % of Si, 6.5-8.5 at. % of Ag and 0.9-2.4 at. % of Pd; and vi) 58.95-69.15 at. % of Au, 12.65-14.65 at. % of Ge, 9-10 at. % of Si, 6.5-8.5 at. % of Ag, 0.9-2.4 at. % of Pd and 1.8-5.5 at. % of Bi.

In one embodiment, said amorphous alloy comprises one or more of the following properties: i) a minimum critical casting thickness of 0.5 mm; ii) a minimum glass transition temperature at 315K; iii) a supercooled liquid region of minimum 10K; iv) an improved thermal stability over the ternary Au—Ge—Si alloys; v) an improved glass forming ability over the ternary Au—Ge—Si alloys; vi) an improved tarnish resistance over the Au—Cu—Si based BMGs.

In one embodiment, said amorphous alloy further comprises one or more of the following properties: i) a minimum Vickers hardness of 200HV; ii) a minimum compressive strength of 480 MPa.

This invention also provides a method for manufacturing the amorphous alloy of this invention. In one embodiment, said method comprises the step of adding elements to a crucible in one of the following order, from bottom to top: i) Pd—Ag—Au—Bi—Ge—Si; ii) Pt—Ag—Au—Bi—Ge—Si; iii) Pd/Pt—Ag—Au—Bi—Ge—Si.

This invention further provides a decorative item comprising at least one component made of the amorphous alloy of this invention.

In one embodiment, said decorative item is a jewelry or an ornament.

In one embodiment, said at least one component is formed by thermoplastic forming or molding.

In one embodiment, said jewelry alloy has improved glass forming ability compared $Au_{76.9}Ge_{13.65}Si_{9.45}$. In TABLE 1, Alloys 1 and 4 are listed for comparative purpose from previous literature, while our invention Alloys 5 to 8 were produced according to the conditions below. The alloys were prepared from individual elements of fineness >99.99%. Individual elements were melted in induction furnace with graphite crucible. The following order of the elements in the crucible can be maintained (from bottom to top): Pd/Pt—Ag—Au—Bi—Ge—Si because it can reduce the formation of palladium and/or platinum silicides or other intermetallic compounds that may lead to crystallization. To achieve rapid cooling, the melts were cast into copper molds. The weight percentage of Au of all example alloys are over 75% so they can be hallmarked as 18 karat gold.

TABLE 1 shows the composition of the alloy example of the current invention and for comparative purpose.

| Alloy | Au at % | Ag at % | Cu at % | Ge at % | Si at % | Pd at % | Bi at % | Sn at % | Ga at % |
|---|---|---|---|---|---|---|---|---|---|
| 1 (Comp.) | 76.9 | — | — | 13.65 | 9.45 | — | — | — | — |
| 2 (Comp.) | 49.0 | 5.5 | 26.9 | — | 16.3 | 2.3 | — | — | — |
| 3 (Comp.) | 51.6 | 5.8 | 20.2 | — | 13.3 | 2.4 | — | 6.7 | — |
| 4 (Comp.) | 51.6 | 5.8 | 20.2 | — | 13.3 | 2.4 | — | — | 6.7 |
| 5 (Inv.) | 69.4 | 7.5 | — | 13.65 | 9.45 | — | — | — | — |
| 6 (Inv.) | 68.2 | 7.5 | — | 13.65 | 9.45 | 1.2 | — | — | — |
| 7 (Inv.) | 65.83 | 7.5 | — | 13.65 | 9.45 | 1.2 | 2.37 | — | — |
| 8 (Inv.) | 63.46 | 7.5 | — | 13.65 | 9.45 | 1.2 | 4.74 | — | — |

The amorphous structures of Alloys 5 to 8 were verified by X-ray diffractometer (Rigaku SmartLab 9KW), using Cu $K_\alpha$ radiation. The diffractograms are shown in FIG. 1; $d_c$ and thermal behavior of Alloys 1 to 8 are listed in TABLE 2. The critical casting thicknesses of Alloys 5 to 8 range from 2 to 7 mm. Compared to the splatted thickness of 20 μm produced of Alloy 1, the examples of present invention showed phenomenal improvement in critical casting thickness. In addition, Bi is highly preferred to add into the system. When Bi is added, $d_c$ can even be increased up to 7 mm. This shows the addition of Bi resulted in a remarkable improvement in glass forming ability in the Au—Ge—Si system.

TABLE 2

Critical thicknesses ($d_c$) and thermal behavior of selected alloys. Data of Alloys 1 to 4 are quoted from previous literature.

| Alloy | $d_c$ (mm) | $T_g$ (K) | $T_x$ (K) | $\Delta T_x$ (K) | $T_l$ (K) |
|---|---|---|---|---|---|
| 1 (Comp.) | 20 μm | 293 | 304 | 11 | / |
| 2 (Comp.) | 5 | 401 | 459 | 58 | 644 |
| 3 (Comp.) | 4 | 370 | / | / | 655 |
| 4 (Comp.) | 3 | 376 | 428 | 52 | 681 |
| 5 (Inv.) | 2 | 317 | 334 | 17 | 672 |
| 6 (Inv.) | 3 | 318 | 344 | 26 | 671 |
| 7 (Inv.) | 5 | 323 | 346 | 23 | 670 |
| 8 (Inv.) | 7 | 324 | 346 | 22 | 665 |

In one embodiment, said jewelry alloy has improved thermal stability. All thermal properties were measured by differential scanning calorimeter (Mettler Toledo DSC3) at a heating rate of 20K/min. The temperatures are also listed in TABLE 2. $T_g$ of Alloy 1 was reported to be 290-295K, and $\Delta T_x$ was 11K. $T_g$ of examples of present invention (Alloys 5-8) range from 317 to 324K, while $\Delta T_x$ is as high as 26K. Higher $T_g$ and larger $\Delta T_x$ indicate higher stability of the supercooled liquid and also higher feasibility in jewelry production by plastic deformation. Introducing Bi into the system does not significantly lower $\Delta T_x$ nor $T_g$ but increase the glass forming ability of the BMG.

In one embodiment, the hardness of said jewelry alloy is suitable for jewelry application. In one embodiment, the Vickers hardness (0.2 kg) of said jewelry alloy is at least 200HV. The Vickers hardness of as-cast Alloy 5 to 8 are shown in TABLE 3.

TABLE 3

Vickers Hardness (0.2 kg) of as-cast alloys of present invention

| Alloy | Hardness (HV0.2) |
|---|---|
| 5 (Inv.) | 200 |
| 6 (Inv.) | 211 |
| 7 (Inv.) | 215 |
| 8 (Inv.) | 208 |

In one embodiment, the strength of said jewelry alloy is suitable for jewelry application. In one embodiment, the compressive strength of said jewelry alloy is at least 480 MPa. A rod-shaped sample of Alloy 7 with ø4 mm diameter and 8 mm height (aspect ratio 1:2) was prepared for compressive strength test. The compressive strength of Alloy 7 was 487 MPa.

In one embodiment, said jewelry alloy has improved tarnish resistance. Tarnish resistance test were performed with reference to ISO 10271. About 8×8×1 mm plates of Alloys 2-7 were prepared. The surfaces of the samples were sanded prior to the test to remove oxide residues formed during casting process. The samples were then immersed into artificial sweat solution and incubated at 37±2° C. for 14 days. The extent of tarnish can be presented by ΔE* and ΔYI compared with their as-polished states. ΔE* describes the total colour deviated. YI is a number calculated from spectrophotometric data that describes the change in colour from colorless through to yellow. All colour measurements were presented in CIELAB coordinates and YI is calculated according to ASTM D1925. The sample alloys of present invention have attractive as polished white colour. Having YI below 13, all sample alloys can be graded as "premium white". All colour measurements are listed in TABLE 4. From the value of Δa* and Δb*, it can be seen that the Au—Cu—Si system metallic glass (Alloy 2 to 4) tarnished to red hue, while the present invention (Alloy 5 to 8) tarnished to yellow hue. Alloys 3 and 4, of which Cu is partially substituted by Sn and Ga respectively, are the alloys said to improve tarnish resistance over Alloy 2. In our experiment, ΔE* and ΔYI of Alloys 3 and 4 were lowered by 2.0-4.1%, showing a slight improvement in tarnish resistance. However, selected alloys in the present invention showed at least 22% reduction in ΔE* and ΔYI. The tarnish resistance of alloys disclosed in this invention definitely has a notable improvement over the previous inventions. High tarnish resistance makes the present invention more suitable in jewelry application.

TABLE 4

Tarnish resistance performance of selected alloys.

| Alloy | ΔL* | Δa* | Δb* | ΔE* | ΔYI |
|---|---|---|---|---|---|
| 2 (Comp.) | −15.35 | +15.05 | +16.80 | 27.28 | +56.68 |
| 3 (Comp.) | −12.25 | +12.35 | +19.54 | 26.16 | +55.54 |
| 4 (Comp.) | −14.09 | +9.61 | +20.06 | 26.57 | +55.25 |
| 5 (Inv.) | −1.65 | +2.45 | +20.20 | 20.41 | +41.00 |
| 6 (Inv.) | −2.20 | +3.69 | +17.32 | 17.85 | +37.62 |
| 7 (Inv.) | −5.64 | +6.09 | +18.73 | 20.49 | +44.30 |

Figure 3A:
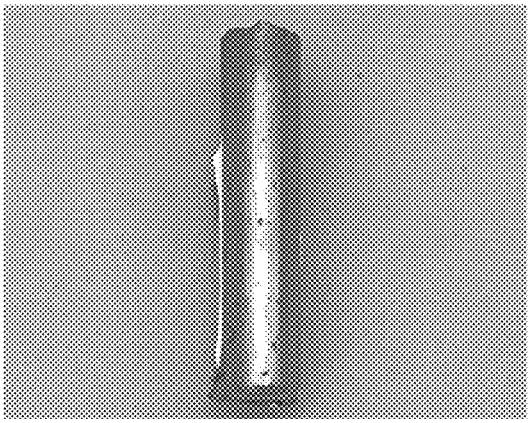
FIG. 3A is an as cast ø3 mm rod of Alloy 7.
Figure 3B:
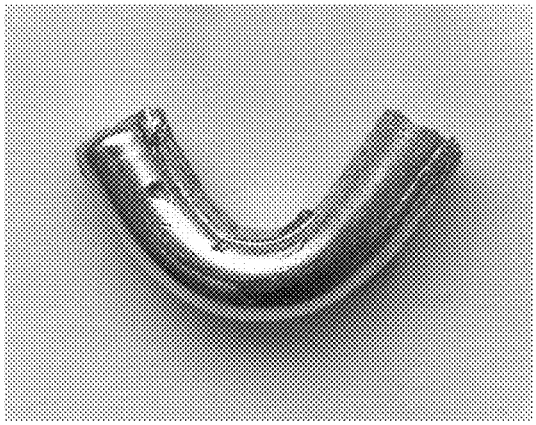
FIG. 3B is the rod in FIG. 3A deformed into u-shape after bending in 328K (under 10× magnification).

In one embodiment, said jewelry alloy is suitable for jewelry manufacturing. Suggested in previous work (Schroers, J. "The superplastic forming of bulk metallic glasses," The Journal of the Minerals, Metals & Materials Society. 57(5), 35-39 (2005)), one possible method to manufacture metallic glasses is thermoplastic forming. Amorphous feedstock materials like granules or other simple geometries with thickness up to 3 mm can be prepared. Under applied pressure, at temperature within supercooled liquid region of the material, the feedstock material can be pressed into a mold of desire shape. Plastic deformation can be observed in Alloys 5 to 8 within their respective $\Delta T_x$. FIG. 3 shows an example of plastic deformation of an as cast ø3 mm rod of Alloy 7. The rod was bent at 328K, 5K above its $T_g$. The rod deformed into a U-shape without any fatigue.

What is claimed is:

1. An amorphous alloy consisting of:

i. 52.55-75.13 at. % of Au;

ii. 11.74-15.55 at. % of Ge;

iii. 8.13-10.77 at. % of Si;

iv. 5-21.13 at. % being at least one element selected from the group consisting of Ag, Bi, Pd and Pt.

2. The amorphous alloy of claim 1, wherein said at least one element is selected from the group consisting of:

i. 5-10 at. % of Ag;

ii. 0.01-8.69 at. % of Bi;

iii. 0.01-2.44 at. % of Pd;

iv. 0.01-2.44 at. % of Pt; and v. 0.01-2.44 at. % of Pd and Pt in total.

3. The amorphous alloy of claim 1, wherein said amorphous alloy consists of: 69.4 at. % of Au; 13.65 at. % of Ge; 9.45 at. % of Si; and 7.5 at. % of Ag.

4. The amorphous alloy of claim 1, wherein said amorphous alloy consists of: 68.2 at. % of Au; 13.65 at. % of Ge; 9.45 at. % of Si; 7.5 at. % of Ag; and 1.2 at. % of Pd.

5. The amorphous alloy of claim 1, wherein said amorphous alloy consists of: 65.83 at. % of Au; 13.65 at. % of Ge; 9.45 at. % of Si; 7.5 at. % of Ag; 1.2 at. % of Pd; and 2.37 at. % of Bi.

6. The amorphous alloy of claim 1, wherein said amorphous alloy consists of: 63.46 at. % of Au; 13.65 at. % of Ge; 9.45 at. % of Si; 7.5 at. % of Ag; 1.2 at. % of Pd; and 4.74 at. % of Bi.

7. The amorphous alloy of claim 1, wherein said amorphous alloy consists of 63.68-73.59 at. % of Au, 12.65-15.55 at. % of Ge, 8.76-10.77 at. % of Si and 5-10 at. % of Ag.

8. The amorphous alloy of claim 1, wherein said amorphous alloy consists of 61.28-72.99 at. % of Au, 12.65-15.55 at. % of Ge, 8.76-10.77 at. % of Si, 5-10 at. % of Ag and 0.6-2.4 at. % of Pd.

9. The amorphous alloy of claim 1, wherein said amorphous alloy consists of 52.59-71.49 at. % of Au, 12.65-15.55 at. % of Ge, 8.76-10.77 at. % of Si, 5-10 at. % of Ag, 0.6-2.4 at. % of Pd; and 1.5-8.69 at. % of Bi.

10. The amorphous alloy of claim 1, wherein said amorphous alloy consists of 66.85-71.85 at. % of Au, 12.65-14.65 at. % of Ge, 9-10 at. % of Si; and 6.5-8.5 at. % of Ag.

11. The amorphous alloy of claim 1, wherein said amorphous alloy consists of 64.45-70.95 at. % of Au, 12.65-14.65 at. % of Ge, 9-10 at. % of Si, 6.5-8.5 at. % of Ag and 0.9-2.4 at. % of Pd.

12. The amorphous alloy of claim 1, wherein said amorphous alloy consists of 58.95-69.15 at. % of Au, 12.65-14.65 at. % of Ge, 9-10 at. % of Si, 6.5-8.5 at. % of Ag, 0.9-2.4 at. % of Pd and 1.8-5.5 at. % of Bi.

13. The amorphous alloy of claim 1, wherein said amorphous alloy comprises one or more of the following properties:

i. a minimum critical casting thickness of 0.5 mm;

ii. a minimum glass transition temperature at 315K;

iii. a supercooled liquid region of minimum 10K.

14. A method for manufacturing the amorphous alloy of claim 1, comprising the step of adding elements to a crucible in one of the following order, from bottom to top: Pd—Ag—Au—Bi—Ge—Si.

15. A method for manufacturing the amorphous alloy of claim 1, comprising the step of adding elements to a crucible in one of the following order, from bottom to top: Pt—Ag—Au—Bi—Ge—Si.

16. A method for manufacturing the amorphous alloy of claim 1, comprising the step of adding elements to a crucible in one of the following order, from bottom to top: Pd together with Pt followed by —Ag—Au—Bi—Ge—Si.

17. A decorative item comprising at least one component made of the amorphous alloy of claim 1.

18. The decorative item of claim 17, wherein said decorative item is a jewelry or an ornament.

19. The decorative item of claim 17, wherein said at least one component is formed by thermoplastic forming or molding.

* * * * *